US009999266B2

(12) United States Patent
Harris

(10) Patent No.: US 9,999,266 B2
(45) Date of Patent: Jun. 19, 2018

(54) GRIPLESS EXERCISE GLOVE

(71) Applicant: Donovan Basil Harris, Streamwood, IL (US)

(72) Inventor: Donovan Basil Harris, Streamwood, IL (US)

(73) Assignee: Donovan Basil Harris, Streamwood, IL (US)

( * ) Notice: Subject to any disclaimer, the term of this patent is extended or adjusted under 35 U.S.C. 154(b) by 0 days. days.

(21) Appl. No.: 14/539,499

(22) Filed: Nov. 12, 2014

(65) Prior Publication Data

US 2015/0128328 A1 May 14, 2015

Related U.S. Application Data

(60) Provisional application No. 61/903,148, filed on Nov. 12, 2013.

(51) Int. Cl.

| | |
|---|---|
| ***A41D 19/00*** | (2006.01) |
| ***A63B 21/00*** | (2006.01) |
| ***A63B 21/065*** | (2006.01) |
| *A63B 21/072* | (2006.01) |

(52) U.S. Cl.

CPC ..... *A41D 19/0037* (2013.01); *A63B 21/065* (2013.01); *A63B 21/4019* (2015.10); *A41D 19/0048* (2013.01); *A63B 21/0726* (2013.01); *A63B 2209/10* (2013.01)

(58) Field of Classification Search

CPC ..... A41D 19/0024; A41D 19/002; A41D 19/01547; A41D 19/0157; A41D 19/0037; A41D 19/0041; A41D 19/01594; A41D 19/0027; A41D 19/003; A41D 19/0044; A41D 19/0048; A41D 19/01; A41D 19/015; A41D 13/08; A41D 19/00; A41D 19/0017; A41D 19/0034; A41D 13/00

USPC ..... 2/160, 16, 161.1, 162, 165, 124; 482/139, 50, 49; 224/218; 272/119

See application file for complete search history.

(56) References Cited

U.S. PATENT DOCUMENTS

| | | | | | |
|---|---|---|---|---|---|
| 461,744 | A | * | 10/1891 | Fanshawe | 2/160 |
| 2,522,344 | A | * | 9/1950 | Carmin | 2/160 |
| 2,524,979 | A | * | 10/1950 | Kimbrell | 2/161.8 |
| 3,490,074 | A | * | 1/1970 | Hardy | 2/159 |
| 4,730,354 | A | * | 3/1988 | Saito | 2/161.2 |
| 4,793,005 | A | * | 12/1988 | Hetzel, Jr. | 2/161.1 |

(Continued)

*Primary Examiner* — Alissa L Hoey
*Assistant Examiner* — Catherine M Ferreira

(57) ABSTRACT

A gripping exercising glove contains an internal support structure, an internal plurality of fastening straps, a traction strip on face. Weight may be attached to glove by the plurality of fastening straps allowing user to perform various exercises without gripping. The internal structure contains an adjustable palm band; an adjustable wrist band; each wraps around and is attached to hand; at the palm and above wrist regions. The two bands are connected by the internal face stabilizing strap and the internal back stabilizing strap. The plurality of fastening straps is laterally and perpendicularly connected to the adjustable palm band, positioned on the inside of the palm. The glove contains a palm side, with plurality of paired slits and wrist opening. These slits traverse the palm side. The support structure is positioned and attached within the with the plurality of fastening straps traversing these paired slits.

12 Claims, 7 Drawing Sheets

(56) References Cited

U.S. PATENT DOCUMENTS

| | | | | | |
|---|---|---|---|---|---|
| 5,182,814 | A | * | 2/1993 | Christensen | 2/161.1 |
| 5,353,440 | A | * | 10/1994 | Meldeau | 2/161.1 |
| 5,898,936 | A | * | 5/1999 | Janes | 2/16 |
| 6,146,319 | A | * | 11/2000 | Tarail | 482/139 |
| 6,286,148 | B1 | * | 9/2001 | Meyer | 2/161.1 |
| 7,058,984 | B2 | * | 6/2006 | Newman | 2/161.2 |
| 8,413,265 | B1 | * | 4/2013 | Hoppes | 2/161.5 |

* cited by examiner

GRIPLESS EXERCISE GLOVE

The current application claims a priority to the U.S. Provisional Patent application Ser. No. 61/903,148 filed on Nov. 12, 2013.

FIELD OF THE INVENTION

The present invention relates generally to exercise accessories. More specifically, the present invention is a gripping exercise glove containing internal gripping features that allows the user to attach free weights and other similar objects to the glove, without requiring the user to physically grasp the object when glove is in use. Additionally, the gripping exercise glove uses an internal support structure to add joint support for the wrist and hand during exercises, which include; an internal circular adjustable palm band, an internal circular adjustable wrist band, an internal face stabilizing strap, an internal back stabilizing strap. Also externally; a traction strip, an external plurality of gripping straps, and an external circular holding band. These internal and external features allows the user to attach free weights and similar object onto the glove. This glove is then able to be placed on the hand allowing the user to hold the weights without physically gripping said weights, for exercise or therapeutic purposes. Traditional gloves are used to aid in protecting hands and for gripping purposes. This invention however while aid in protecting hands allows the user to hold objects without gripping objects with hands.

BACKGROUND OF THE INVENTION

Physical exercises is any bodily activity which promotes and maintains a person's physical fitness and mental health, an essential activity for a long and healthy life. Physical exercise promotes a healthy cardiovascular system, strengthens and builds muscles, burns unnecessary fat, reduces stress and anxiety, promotes healthy self-esteem, and releases endorphins to list a number of the numerous benefits. Two major reasons that drive human to engage in physical activities include athletic competition and physical fitness as they are highly regarded in today's society. Sport-base activities provide healthy hobbies for the individual as well as bring people together, promote fitness, provide entertainment, and in some cases lead to fame and fortune. The gripping exercise glove will help the user to aspire to and achieve these goals.

Free weights are a popular accessary for physical exercises but they require the user to grip the equipment during the operation resulting in a physical limitation on the arms and hands movements and therefore other exercise activities that may be performed. It is therefore an object of the present invention to provide an exercise glove that does not require the user to grip the free weight or exercise object with fingers. The present invention allows the user to attach a weight to the glove without requiring the user's hands to grip the object or weight therefore relieving the hands and arm muscles, thus reducing the amount of stress applied to the fingers, wrist joint and the associated muscles in the area; this allows for a greater variety of physical exercise and activities. With the hand being open, the weight may be distributed on to different portions of the body depending on the position and activity of the user, for example raising the hands above the head will distribute the weight to the back of the body and on the boney structure of the hands and arms, while lowering the weights from above the head to a ninety degree angle position will display the weight on the abdominal area, allowing the user to engage in abdominal exercises while standing, without gripping the weights. The present invention gives a unique approach to exercise for everyone. The present invention may be used for muscle toning, stretching, aerobic, cardiovascular, deep breathing exercises and many more. Additionally the present invention may also be utilized for physical therapy and strengthening exercises. Furthermore, the present invention helps the user to perform activities such as martial arts, yoga, Pilates, and other similar movement base exercises. It also aids in preventing the users from developing calluses in the hands and allows those who suffer from debilitating joint pain to have a better way to exercise without the excruciating pain and many more advantages that are not available with traditional gloves usage.

DETAIL DESCRIPTION OF THE INVENTION

All illustration of the drawings are for the purpose of describing selected versions of the present invention and are not intended to limit the scope of the present invention.

The present invention is a gripping exercise glove which allows the user to perform a variety of nontraditional physical activities with a weighted object, more specifically a dumbbell or free weight of sort, without the user gripping the weight; the glove engages the weights and does the gripping. The present invention uses a multitude of straps distributed from inside the glove and about the front surface to wrap around, secure and support the weight. The internal and external gripping features of the present invention allow the user to vary the weight being held by the gripping exercise glove without using the gripping capabilities of the user's fingers. In addition to being highly compatible with traditional free weights found in the majority of gyms, the present invention may also be used with equipment that require a secure and steady grip such as an elongated barbell most often used for squatting, bench pressing, and dead lifting.

Figure 1:
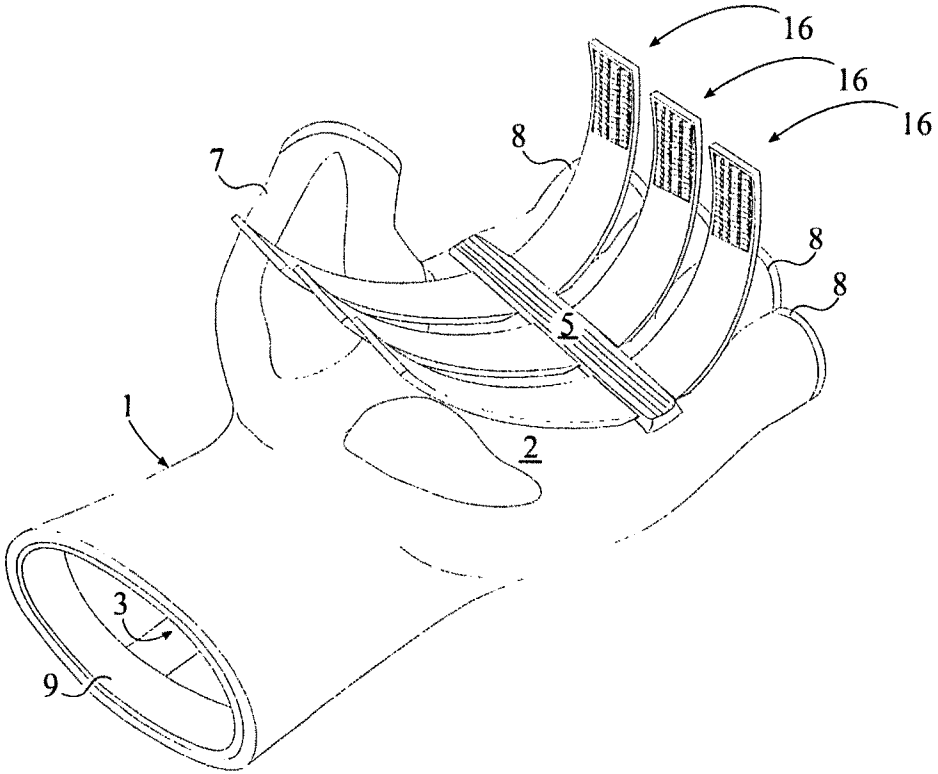
FIG. 1 is a face perspective view of the present invention.
Figure 2:
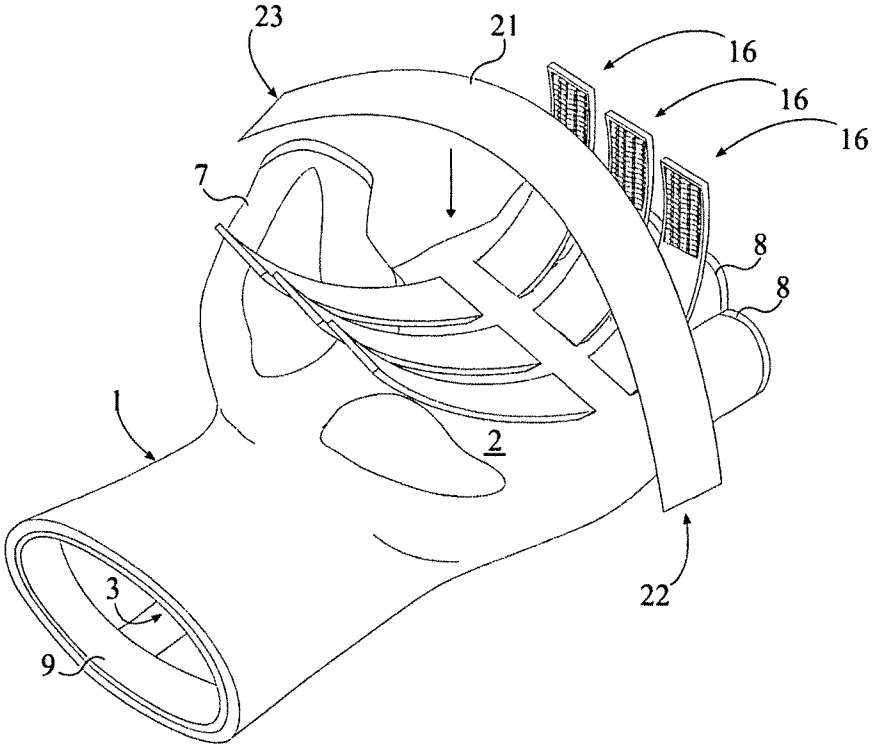
FIG. 2 is a face perspective view of an alternative embodiment of the present invention, for more stability.
Figure 3:
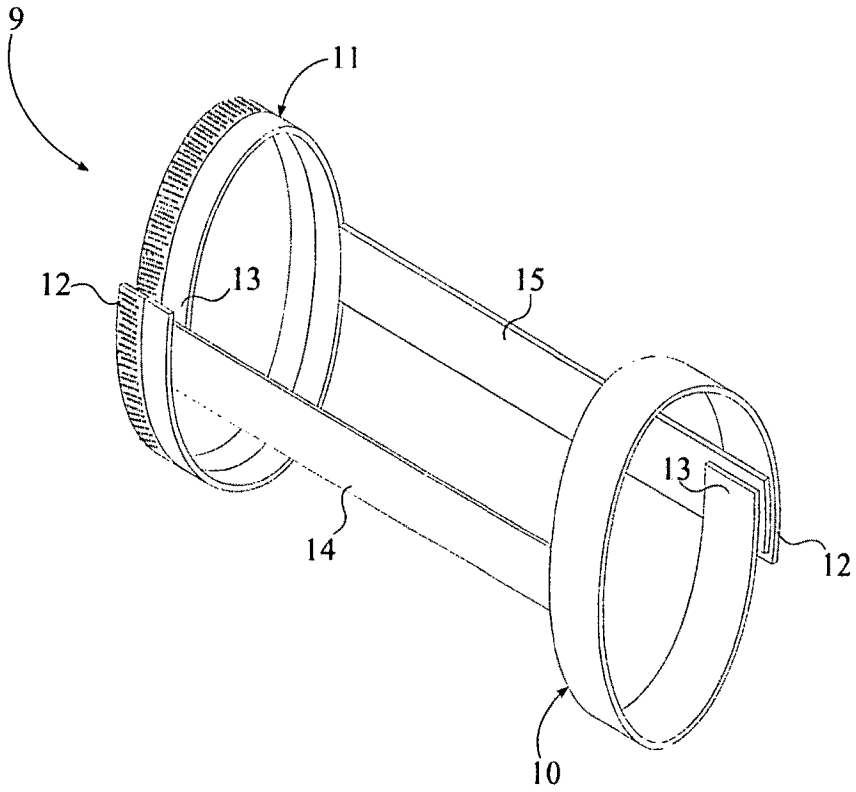
FIG. 3 is a side perspective view of the internal support structure of the present inventions the internal adjustable palm band 10, the internal adjustable wrist band 11, the internal face stabilizing strap 14 and the internal back stabilizing strap 15.
Figure 4:
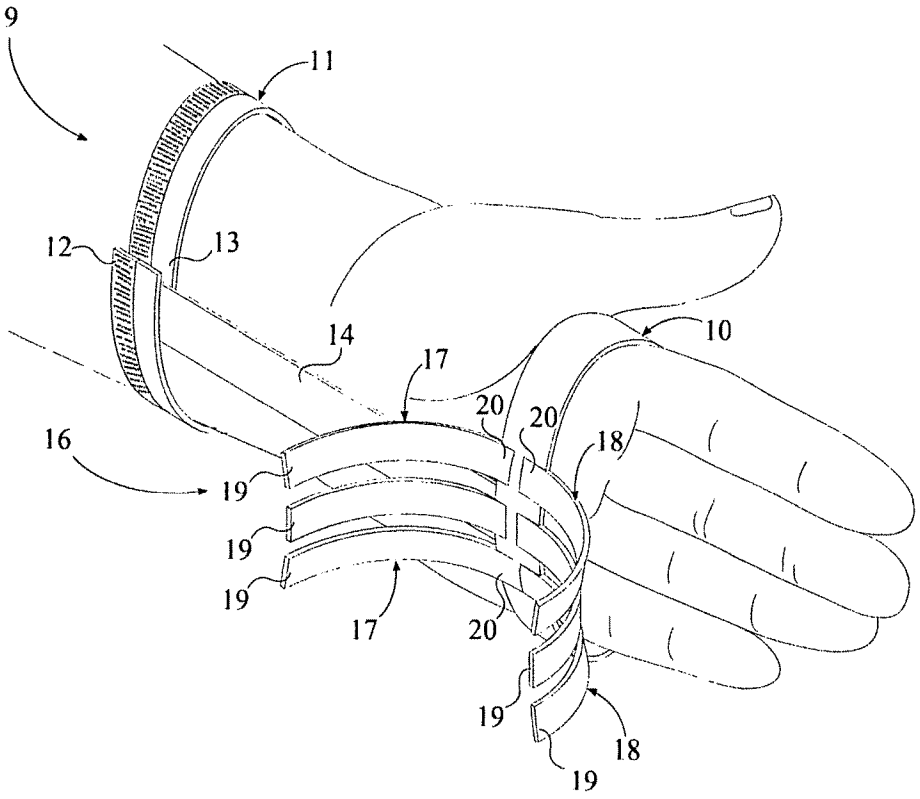
FIG. 4 is a face perspective view of the internal support structure attached to the internal plurality of fastening straps 16, placed on a user's hand.
Figure 5:
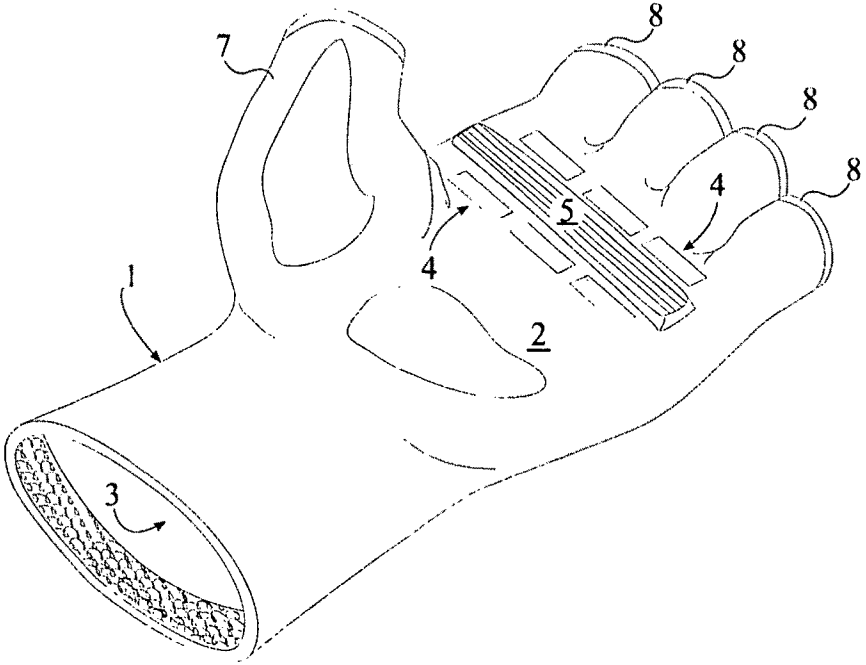
FIG. 5 is a face perspective view of glove of the present invention which consist of a sleeve with a hook or loop connection inside to connect with the internal circular adjustable wrist band. It also consist of a plurality of slits 4, for the exiting of the internal plurality of fastening straps. And an external traction strip 5, in the palm area.
Figure 6:
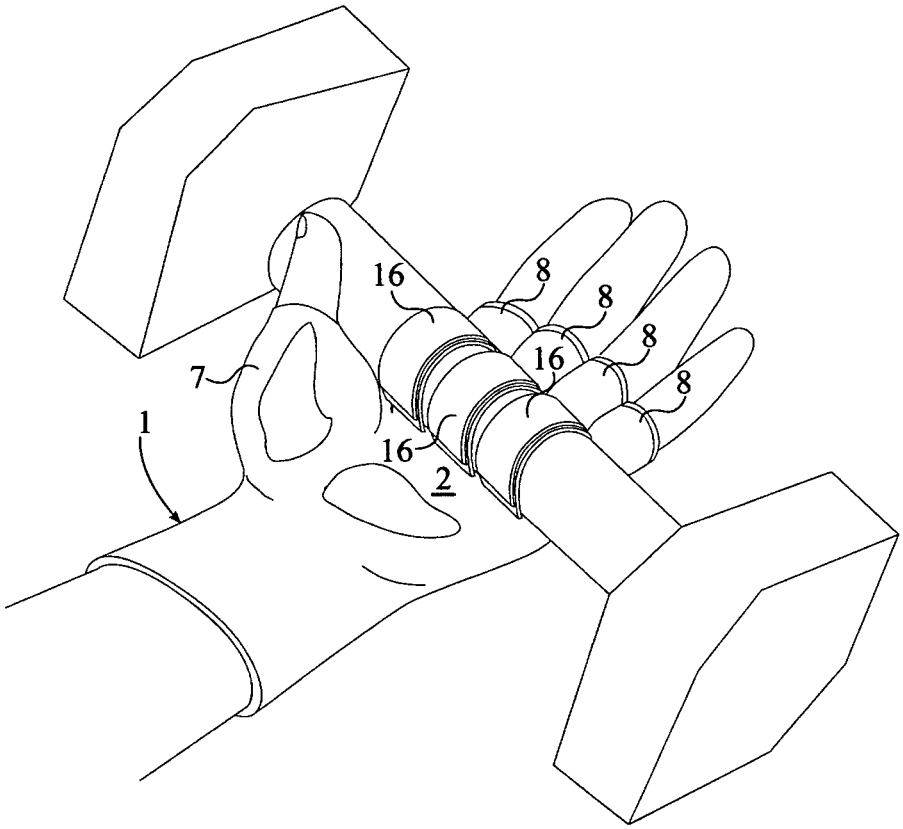
FIG. 6 is a face perspective view of the present invention attached to a hand showing the internal plurality of fastening straps of the present invention exiting glove and engaging the free weight with the external plurality of straps.

The present invention is comprised of internal support structures FIG. 3, within the glove FIG. 1, with various parts: An internal circular adjustable wrist band with a hook or loop connection on either end 9, an internal circular adjustable palm band with a hook or loop connection at either end 10, an internal face stabilizing strap with a hook or loop connection on either end 14, an internal back stabilizing strap with a hook or loop connector on either end. An internal plurality of fastening straps with hook or loop connection on either end 16, as seen in FIG. 4. An internal hook or loop connector in sleeve of glove as seen in FIG. 5, a traction strip on the palm face of glove as seen in FIG. 5, and a housing bond 21, as seen in FIG. 2. The internal support structure 9 fastens the present invention to the hand of the user, specifically to the palm and above the wrist regions as seen in FIG. 4. The internal support structure 9 mitigates the stresses felt by the wrist joint by providing structural support to the joints, redirecting weight stresses to alternative regions of the body, when in use. The glove 1, covers and protects the majority of the user's hands from training abrasions while simultaneously maintaining contact with the lifting surface of the weight. As shown in FIG. 6 and FIG. 4, the plurality of fastening straps 16 are used to grip and couple a free weight, or a similar object, to the internal support structure, the glove 1, the user's hand.

Figure 7:
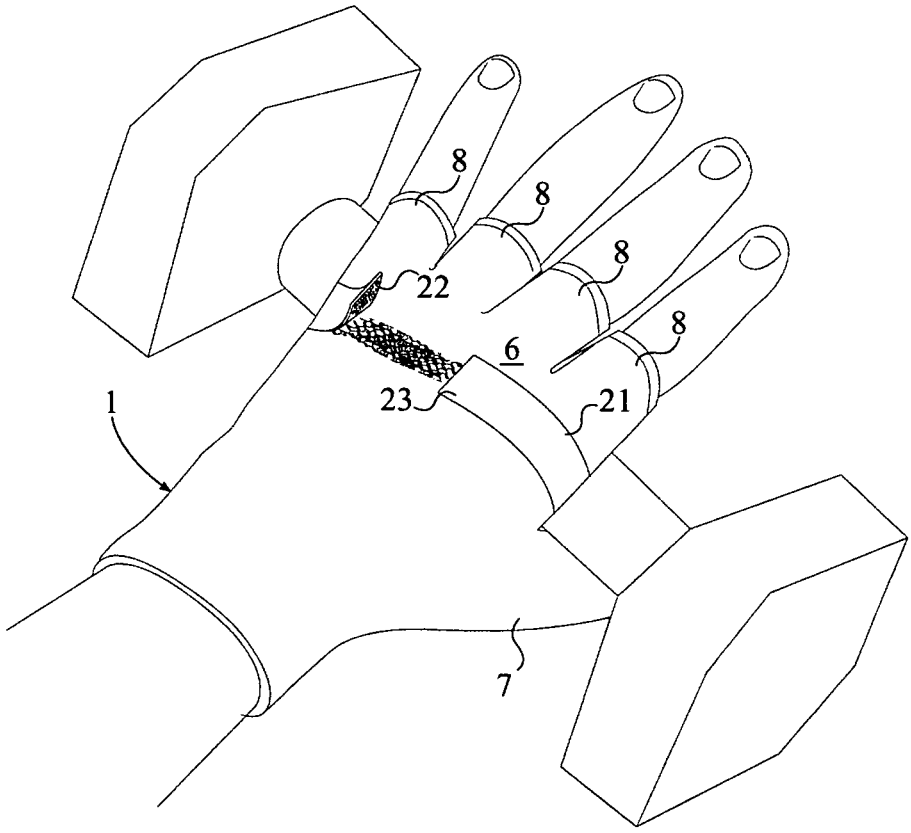
FIG. 7 is a back perspective view of an alternative embodiment of the present invention, a housing bond; when placed on glove and attached to back as seen, helps to stabilize glove.

Referring to FIG. 3 and FIG. 4, the internal support structure 9 comprises an internal adjustable palm band 10, an internal adjustable wrist band 11, an internal face stabilizing strap 14, and an internal back stabilizing strap 15. The internal adjustable palm band 10 and the internal adjustable wrist band 11 are placed around the palm and the wrist of the hand while the internal face stabilizing strap 14 and the internal back stabilizing strap 15 provide the structural support by connecting the two bands together. The internal adjustable wrist band 11 and the internal adjustable palm band 10 are positioned coincident and offset to each other When assembled the internal adjustable palm band 10 in FIG. 4, inside of glove goes directly around the palm area between the thumb and the metacarpals region of the hand, the internal circular adjustable wrist band 11, inside of glove goes directly around the wrist area and is connected one to two inches above the wrist FIG. 4 and is also attached to the internal connector in the glove sleeve FIG. 1:9. The internal back stabilizing strap 15 in FIG. 3 is fasten to the inside portion of the adjustable wrist band, at the back of wrist and is connected to the midpoint of the inside portion of the internal circular adjustable palm band at the back of hand. The internal face stabilizing strap 14 is fasten to the midpoint of the inside portion of the internal circular adjustable wrist band 11 and is connected to the midpoint of the inside portion of the internal circular adjustable palm band 10 as seen in FIG. 3. The plurality of fastening straps 16, in FIG. 4 is laterally and perpendicularly connected to the internal adjustable palm band 10; the preferred but not limited number of fastening straps 16 are three to ensure a secure hold. The internal plurality of fastening straps 16 are distributed along the internal adjustable palm band 10, adjacent to the first internal stabilizing straps 14 as seen in FIG. 4. This design places the internal plurality of fastening straps 16 in the center of the palm of the hand. These straps are then transverse through the plurality of paired slits 4 in the palm area of the glove FIG. 5 to engage the weight as seen in FIG. 6. The external features include; a traction strip 5 as seen in FIG. 5; this traction strip helps to stabilize and prevent excess movement of weight on glove. There is an external circular holding band 21 that is placed around the glove as seen in FIG. 2, from the palm area between the fingers and thumb of the glove to the side of glove with traction strips on the center of holding band to stabilize weights as seen in FIG. 7.

The majority of exercises which uses free weights require the wrist joint to stay locked or move up and down; it is an object of the present invention to provide joint support specifically for such movements in order to prevent hyperextension and excessive stress application to the wrist of the user. While lifting weight without this invention the weight is displaced directly on the wrist, one of the intent of this invention is to shift this weight from the wrist and equally distribute this weight to the entire arm.

In the preferred embodiment, the internal face stabilizing strap as seen in FIG. 3, 14 and the internal back stabilizing strap 15 are oriented parallel and offset to each other for equal support above and below the wrist. One end of the internal face stabilizing strap 14 is adjacently and perpendicularly connected to the internal adjustable palm band 10, while the other end of the first internal face stabilizing strap 14 is adjacently and perpendicularly attached to the internal adjustable wrist band 11, opposite the internal adjustable palm band 10. One end of the internal back stabilizing strap 15 is adjacently and perpendicularly connected to the internal adjustable wrist band 11, opposite the internal face stabilizing strap 14, while the other end is adjacently and perpendicularly attached to the internal adjustable palm band 10. This configuration places the internal face stabilizing strap 14 on the inside of the hand, running from the middle of the palm to two inches above the wrist. Additionally, this configuration places the internal back stabilizing strap 15 on the back of the hand, running from the middle of the back of hand to two inches above wrist.

The glove FIG. 1 comprises a palm side 2, a wrist opening 3, a plurality of paired slits 4 of FIG. 5, the back 6, a thumb sleeve 7, and at least one finger sleeve 8. Various other features and aspects may also be incorporated into the present invention; features include but are not limited to, close finger sleeves, additional padding, adjustable wrist straps, through holes and slits for ventilation, and other features common to exercise. The internal support structure 9 in FIG. 4, is positioned within the glove FIG. 1 with the internal adjustable wrist band 11 in FIG. 3 being positioned and attached adjacent to the wrist opening 3 in FIG. 1, in order to couple the glove 1 in FIG. 1 and the internal support structure 9 in FIG. 3. In the preferred embodiment, the wrist opening 3 in FIG. 1 and the internal adjustable wrist band 11 in FIG. 3 contain complimentary hook-and-loop fasteners to engage and laterally attach the internal adjustable wrist band 11 in FIG. 3 to the glove 1 in FIG. 1; alternative fastenings means and fastening regions may be instead or in addition to the hook-and loop fasteners. The plurality of paired slits 4 in FIG. 5 is positioned adjacent to the internal adjustable palm band 10 in FIG. 4 and traverse through the palm face 2 in FIG. 1 in order to facilitate the placement of the plurality of fastening straps 16. Each of the plurality of fastening straps 16 traverses through a corresponding pair of slits from the plurality of paired slits 4 as seen in FIG. 1. The plurality of fastening straps 16 is located inside the palm region and allows the user to attach free weights and other similar objects to the glove FIG. 1 as seen in FIG. 6 and FIG. 7.

Each of the internal plurality of fastening straps 16, as seen in FIG. 4, comprises a first strip 17 and a second strip 18 of a certain length depending on the size of the bars being lifted. The first strip 17 and the second strip 18 each comprise a coupling end 19 and a fixed end 20. The fixed end 20 of the first strip 17 is position adjacent to the fixed end 20 of the second strip 18, and both are connected to the internal adjustable palm band 10. Contrary to the fixed end 20, the coupling end 19 is free moving and contains a fastening mechanism that allows the coupling end 19 of the first strip 17 and the second strip 18 to attach to each other to form a circular hold around weights or other similar objects as seen in FIG. 6. Fastening mechanism include, but are not limited to, hook and loop fastening, buttons, adhesive, clips, and other similar mechanism.

The internal plurality of fastening straps 16, are attached equally across the internal adjustable palm band 10 in the center of the palm area as seen in FIG. 4. The internal face stabilizing strap 14, is located on the inside portion of the hand; running horizontally from the center of the palm; one to two inches above the wrist as seen in FIG. 4. The internal adjustable wrist band 11, is connected to the internal face stabilizing strap above the wrist at 12 and 13 as seen in FIG. 4.

In the preferred embodiment, a traction strip 5 as seen in FIG. 1, is located on the palm region of the glove 1, which prevents the attached weight from translating or rotating while been held by the present invention. The traction strip 5 is oriented parallel to the internal adjustable palm band 10 and is externally connected across the palm side 2 as seen in FIG. 5. Furthermore, the traction strip 5 is positioned between each of the plurality of paired slits 4 such that when an object is attached it is in direct contact with the traction strip 5. The traction strip provides a gripping affect through a high friction material composition such as leather, and or other similar materials. Additionally, in the preferred embodiment, the internal adjustable palm band 10, the internal adjustable wrist band 11, the internal face stabilizing strap 14, and the internal back stabilizing strap 15 all utilize hook-and loop fasteners to allow the user to adjust the size and other similar characteristics of the present invention to his or her personal preference. More specifically, the internal adjustable palm band 10 and the internal adjustable wrist band 11 have an attachment strip. The attachment strip comprises a first fastening end 12 and a second fastening end 13. The first fastening end 12 and the second fastening end 13 are positioned opposite to each other along the attachment strip. The structure of glove and attachment strips are composed of a strong, flexible, and nonabrasive material which human skin may be exposed to for a prolonged period of time; material composition include, but are not limited to, leather, rubber, and other similar materials. There are different skin types; some are sensitive, some are tough others are in the middle. Therefore different types of materials should be considered without compromising the integrity of the glove. Durability and comfort should not be compromise.

To attach the parts of the present invention, the internal adjustable palm band 10 and the internal adjustable wrist band 11 are permanently attached at the center with one end of the internal face stabilizing strap and the internal back stabilizing strap on opposite sides respectively, as seen in FIG. 3. The internal adjustable palm band is connected to itself at the ends and the internal adjustable wrist band is connected to itself at the ends as seen in FIG. 3. The first fastening end 12 is engage to the second fastening end 13 of each attachment strip through a hook-and-loop fastener. Next the unconnected ends of the internal face stabilizing strap 14 and the internal back stabilizing strap 15 are positioned and attached between the attachment strips as seen in FIG. 3. The internal back stabilizing strap 15 is adjacently attached to the engagement between the first fastening end 12 and the second fastening end 13 of the internal adjustable palm band 10; this is accomplished through another hook-and loop fastener. The internal face stabilizing strap 14 is diametrically opposed to the internal back stabilizing strap 15 about the internal adjustable palm band 10. In similar fashion, the internal face stabilizing strap 14 is adjacently attached to the engagement between the first fastening end 12 and the second fastening end 13 of the internal adjustable wrist band 11. The internal back stabilizing strap 15 is diametrically opposed to the internal face stabilizing strap 14 about the adjustable wrist band 1. Next the internal plurality of fastening straps are connected to the internal adjustable palm band as seen in FIG. 4. The internal support structure is then placed on hands, adjustments are made for comfort. Next the glove 1 is put over the hand; the internal support structure 9, and secured via the hook-and-loop fastener on the wrist opening 3 and the internal adjustable wrist band 11. Simultaneously, the plurality of fastening straps 16 are fed through the plurality of paired slits 4; to secure the glove to the internal support structure; where they are free to engage the weight as seen in FIG. 1 and FIG. 6. Adjustments are made again for comfort. The method of securing these mechanisms allow the uniqueness of each person's hand to be placed in a more comfortable space adjusted to that hand. This allows for a more effective workout.

Along with the traction strip 5 a holding band can also be used. The holding band 21 comprises a first end 22 and a second end 23; the holding band 21 is positioned around the glove 1 as seen in FIG. 2 and FIG. 7. The holding band 21 is positioned between each of the plurality of paired slits 4 and thus coupling the internal support structure 9, the plurality of fastening straps 16, and the glove 1 together for a tighter hold around the user's hand. The first end 22 and the second end 23 are attached to the back of glove 6 through a hook-and -loop fastening mechanism as seen in FIG. 7. This embodiment helps to ensures that neither the glove 1 nor the internal support structure 9 translate or rotate relative to each other or the user's hand. The holding band contains a traction strip on either side of band.

Strong, flexible and none abrasive materials such as: leather, rubber, cotton and other materials of such qualities should be used in making the glove. Leather is preferred for the face of the glove for protection of palm while the back should be made of a strong flexible breathable cloth like material for comfort and flexibility. All new materials that are compatible are allowed to be use.

Although the invention has been explained in relation to its preferred embodiment, it is to be understood that many other possible modifications and variations can be made without departing from the spirit and scope of the invention as hereinafter claimed.

What is claimed is:

1. A gripping exercise glove comprises: a glove including: an internal support structure; a plurality of internal fastening straps; the internal support structure comprises an internal circular adjustable palm band, an internal circular adjustable wrist band, a first internal back stabilizing strap, and a second internal back stabilizing strap; the glove further includes a palm side, a wrist opening, and a plurality of paired slits; the first internal circular adjustable palm band and the second internal circular adjustable wrist band being positioned coincident and offset each other; the first internal stabilizing strap and the second internal stabilizing strap being positioned between the internal circular adjustable palm band and the internal circular adjustable wrist band; the plurality of fastening straps being laterally and perpendicularly connected to the internal circular adjustable palm band; the plurality of internal fastening straps being distributed along the internal circular adjustable palm band, adjacent to the first/front first internal stabilizing strap; the internal support structure being positioned within the glove the internal circular adjustable wrist band being positioned adjacent to the wrist opening; the plurality of paired slit traversing through the palm side; the plurality of paired slits being positioned adjacent to the internal circular adjustable balm band; and each of the plurality of internal fastening straps traversing through a corresponding pair of slits from the plurality of paired slits to engage an object.

2. The gripping exercise glove as claimed in claim 1 comprises: the first internal face stabilizing strap and the second internal back stabilizing strap being oriented parallel and offset to each other; the first internal face stabilizing strap adjacently and perpendicularly connected to the midpoint of the internal circular adjustable palm band; the first internal face stabilizing strap being adjacently and perpendicularly attached to the midpoint of the internal circular adjustable wrist band, opposite the internal circular adjustable palm band; the second internal back stabilizing strap being adjacently and perpendicularly connected to the internal circular adjustable wrist band, opposite the first internal face stabilizing strap; and the second internal back stabilizing strap being adjacently and perpendicularly attached to the internal circular adjustable palm band; the first internal face stabilizing strap being adjacently and perpendicularly attached to the internal circular adjustable wrist band, opposite the internal back stabilizing strap; and the second internal back stabilizing strap being adjacently and perpendicularly attached to the internal circular adjustable palm band.

3. The gripping exercise glove as claimed in claim 1 comprises: a clove further including a traction strip; the traction strip being oriented parallel to the internal circular adjustable palm band; the traction strip being externally connected across the palm side; and the traction strip being positioned in between each of the plurality of paired slits.

4. The dripping exercise glove as claimed in claim 1 comprises: each of the plurality of internal fastening straps; comprises a first strip and a second strip; the first strip and the second strip each comprises a coupling end and a fixed end; the fixed end of the first strip being positioned adjacent to the fixed end of the second strip; and the fixed end for both the first strip and the second strip being connected to the internal adjustable palm band.

5. The gripping exercise glove as claimed in claim comprises: the internal circular adjustable palm band and the internal circular adjustable wrist band each being an attachment strip; the attachment strip comprises a first fastening end and a second fastening end; the first fastening end and the second fastening end being positioned opposite to each other along the attachment strip; and the first fastening end being engaged to the second fastening end.

6. The dripping exercise glove as claimed in claim 2 comprises: the second internal back stabilizing strap being adjacently attached to the engagement between the first fastening end and the second fastening end of the internal circular adjustable palm band; and the first internal face stabilizing strap being diametrically opposed to the second internal back stabilizing strap being adjacently attached to the engagement between the first fastening end and a fastening section of the internal circular adjustable palm band.

7. The gripping exercise glove as claimed in claim 2 comprises: the internal face stabilizing strap, being adjacently attached to the engagement between the first fastening end and the second fastening end of the internal circular adjustable wrist band; the second internal back stabilizing strap being diametrically opposed to the first internal face stabilizing strap being adjacently attached to the engagement between the second fastening end and a fastening end of the internal circular adjustable wrist band.

8. The gripping exercise glove as claimed in claim 1 comprises: a holding band; the holding band including a first end and second end; the holding band being positioned around the glove; the holding band being positioned between each of the plurality of paired slits; the first end and the second end being attached to the back side of the glove.

9. The gripping exercise glove as claimed in claim 3 comprises: the glove further including a traction strip; the traction strip being oriented parallel to the internal circular adjustable palm band; the traction strip being externally connected across the palm side of glove; and the traction strip being positioned in between each of the plurality of paired slits on the clove.

10. The gripping exercise glove as claimed in claim 1 comprises: an internal plurality of fastening straps; consisting of a first strip and a second strip; the first strip and the second strip each including two coupling ends and a fixed end; the fixed end of the first strip being positioned adjacent to the fixed end of the second strip; and the fixed end for the straps being connected to the mid-point of the internal circular adjustable palm band.

11. The gripping exercise glove as claimed in claim 1 comprises: the internal circular adjustable palm band and the internal circular adjustable wrist band each including an attachment strip; the attachment strip consisting of: a first fastening end and a second fastening end; the first fastening end and the second fastening end being positioned opposite to each other along the attachment strip and the first fastening end being engaged to the second fastening end.

12. The gripping exercise glove as claimed in claim 7 comprises: the second internal back stabilizing strap being adjacently attached to the engagement between the first fastening end and the second fastening end of the internal circular adjustable palm band.

* * * * *